US005094089A

United States Patent [19]

Lail

[11] Patent Number: 5,094,089

[45] Date of Patent: Mar. 10, 1992

[54] DRIVING SYSTEM FOR DUAL TANGENTIAL BLOWERS IN AN AIR CONDITIONER

[75] Inventor: Jimmy E. Lail, Murfreesboro, Tenn.

[73] Assignee: Inter City Products Corporation (U.S.A.), LaVergne, Tenn.

[21] Appl. No.: 478,410

[22] Filed: Feb. 12, 1990

[51] Int. Cl.[5] ..... F25D 17/07

[52] U.S. Cl. ..... 62/429; 62/262

[58] Field of Search ..... 62/429, 262, 428, 259.1; 415/60, 61, 122.1

[56] References Cited

U.S. PATENT DOCUMENTS

| | | | |
|---|---|---|---|
| 2,323,511 | 7/1943 | Baker | 62/429 X |
| 2,499,411 | 3/1950 | Pennington | 62/429 |
| 3,200,609 | 8/1965 | Laing | 62/262 |
| 3,301,003 | 1/1967 | Laing | 62/262 |
| 3,404,539 | 10/1968 | Laing | 62/262 |
| 4,100,764 | 7/1978 | Murano | 62/262 |
| 4,111,000 | 9/1978 | Sakazume et al. | 62/262 |
| 4,367,636 | 1/1983 | Sakuma et al. | 62/262 |
| 4,478,053 | 10/1984 | Yano et al. | 62/262 |

FOREIGN PATENT DOCUMENTS 60-62530 4/1985 Japan .

OTHER PUBLICATIONS

Publication: An Experimental Study of Cross Flow Fan, S. Murata and K. Nisnihara, 1976.

Publication: The Effect of Rotor and Casing Design on Cross-Flow Fan Performance, D. J. Allen AT9/1982.

*Primary Examiner*—Albert J. Makay

*Assistant Examiner*—John Sollecito

*Attorney, Agent, or Firm*—Baker & Daniels

[57] ABSTRACT

The present invention is an air conditioning unit with indoor and outdoor heat exchanger coils and a pair of dual tangential flow blowers. The blowers are driven by a single motor. The motor directly drives the first blower which is rotatably connected to the second blower. The rotational driving connection of the blowers is located on the opposite side of the motor and compressor.

8 Claims, 2 Drawing Sheets

DRIVING SYSTEM FOR DUAL TANGENTIAL BLOWERS IN AN AIR CONDITIONER

BACKGROUND OF THE INVENTION

This invention relates to air conditioners and heat pumps and in particular to self contained packaged air conditioner and heat pump units which include both indoor and outdoor coils and a pair of blowers.

Conventional packaged air conditioners and heat pumps generally include both a conventional centrifugal blower for the indoor heat exchanger and an axial blower for the outdoor heat exchanger. All conventional packaged terminal air conditioners also include some type of dividing wall which divides the indoor portion of the unit from the outdoor portion of the unit. Air is conventionally drawn into the unit through the sides, the rear, the outside face, or the bottom of the unit and is blown out of the unit after passing over the heat exchangers.

Some prior art air conditioners have included tangential or cross flow blowers for the indoor heat exchanger. U.S. Pat. No. 4,478,053 discloses an air conditioner which includes two vertically mounted cross flow blowers, one of which is used to move air across the indoor heat exchanger and the other which is used to move air across the outdoor heat exchanger. This patent shows separate motors for driving the two blowers. Other prior art air conditioners have used centrifugal or axial flow blowers.

Several problems have been encountered with the prior art air conditioners with axial flow fans and centrifugal blowers described above. One problem is the significant cost of providing a separate motor for each blower. Another problem is that the air flow through or across the heat exchangers is non-uniform due to the non-uniform performance characteristics of prior art blowers whereby hot spots develop in the heat exchangers, thus causing the heat transfer process to be less efficient than desired.

Another problem with these prior art air conditioners has been that they are rather noisy. The noise is primarily created by the air flow through the unit because prior art centrifugal or axial flow blowers generate substantial expansion and contraction of the air and cause impact of the blower blades upon the air. Such noise is particularly undesirable as packaged air conditioners are commonly used in dwelling places, either by mounting through a wall or in a window.

Another problem with prior art self contained air conditioners has been that, due to the types of blowers used, the depth dimension of the unit is much greater than is desired. Thus the prior art units tend to take up much more space in the dwelling than is desired.

U.S. Pat. Nos. 3,200,609 (Laing) and 3,301,003 (Laing) disclose air conditioners which use two cross flow blowers. Both of these patents disclose air conditioners with various arrangements of the evaporator and condenser coils and of the cross flow blowers. Each side of the air conditioner has a heat exchanger coil in communication with the indoor or outdoor air, respectively. Cross-flow blowers are positioned in respective interior regions for inducing air flow through approximately half of the heat exchanger and for forcibly blowing air through the other half of the heat exchanger. The respective interior regions are located on opposite sides of a divider wall which includes additional curved wall portions for guiding the flow of air away from the respective cross-flow blower. The air conditioner design of Laing reduces the width of the air conditioner by positioning the cross-flow blowers in a vertical stacked arrangement. However, many problems exist with the air conditioner of Laing.

One problem with the Laing air conditioner involves the blower drive. In Laing, a single motor in conjunction with a pulley system drives the two blowers. However, the pulley system has a single belt and three pulleys, one rotatably mounted on the motor and the other two rotatably mounted on the blowers. The motor is located on the same side of the air conditioner as the compressor, pump, and other components which can potentially cause a high temperature environment, reducing the belt life. Repairing or replacing the belt is difficult because of the restricted space within the motor/compressor area. To accomplish repair or replacement, the motor must be removed, which can be a complicated and time consuming task. Further, the three pulley coupling is more vulnerable to misalignment than a two pulley system because each additional pulley compounds the chance of misalignment.

It is therefore desired to provide a self contained packaged air conditioning unit wherein the blowers are driven more reliably and efficiently.

It is furthermore desired to provide a self contained packaged air conditioning unit wherein only one motor is required to drive the blowers.

SUMMARY OF THE INVENTION

The present invention, in one form thereof, overcomes the disadvantages of the above described prior art air conditioners by providing an improved air conditioner therefor. The air conditioner according to the present invention includes dual cross flow or tangential blowers which are horizontally mounted. The blowers are driven by a single motor, with the motor directly driving one of the blowers. The directly driven blower is rotatably connected to the other blower By means of this arrangement the blowers can be driven by a single motor and minimize the complexity of the blower driving system.

In addition, one blower is driven by a single motor and the other blower is drivingly connected to the one blower on the opposite side of the motor allowing for easy repair and replacement of the rotational coupling.

The present invention, in one form thereof, comprises an air conditioner including a housing, two tangential blowers, a motor, and a rotatable coupling The housing includes two compartments each having a tangential blower mounted therein. The motor directly rotates one blower and the coupling transmits rotational motion to the other blower.

The present invention, in another form thereof, comprises a packaged terminal air conditioner including a housing, a compressor, two tangential blowers, a controller, a motor, and a rotational coupling. The housing includes indoor and outdoor heat exchanger coils, and has two compartments. The compressor is connected to the indoor and outdoor heat exchanger coils on one side of the housing. Tangential blowers are mounted in a respective compartment of the housing, and each blower has an axis about which the blower rotates. The controller selects the operational mode of the air conditioner, with the modes including heating, cooling, and fan only modes. The motor rotates one blower and is located on the one side of the housing; and the motor is connected to the axis of the first blower. The coupling rotatably couples the blower axes, with the coupling located opposite the compressor side of the housing. The coupling is structured and arranged so that the motor directly drives the one blower and transmits rotational motion to the other blower.

One object of the present invention is to provide an air conditioner which requires only one motor to drive both the indoor and outdoor blowers.

A further object of this invention is to provide an air conditioner with dual tangential blowers wherein the coupling between blowers is located on the side opposite the refrigeration components.

BRIEF DESCRIPTION OF THE DRAWINGS

The above mentioned and other features and objects of this invention and the manner of attaining them will be more apparent and the invention itself will be better understood by reference to the following description of an embodiment of the invention, taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
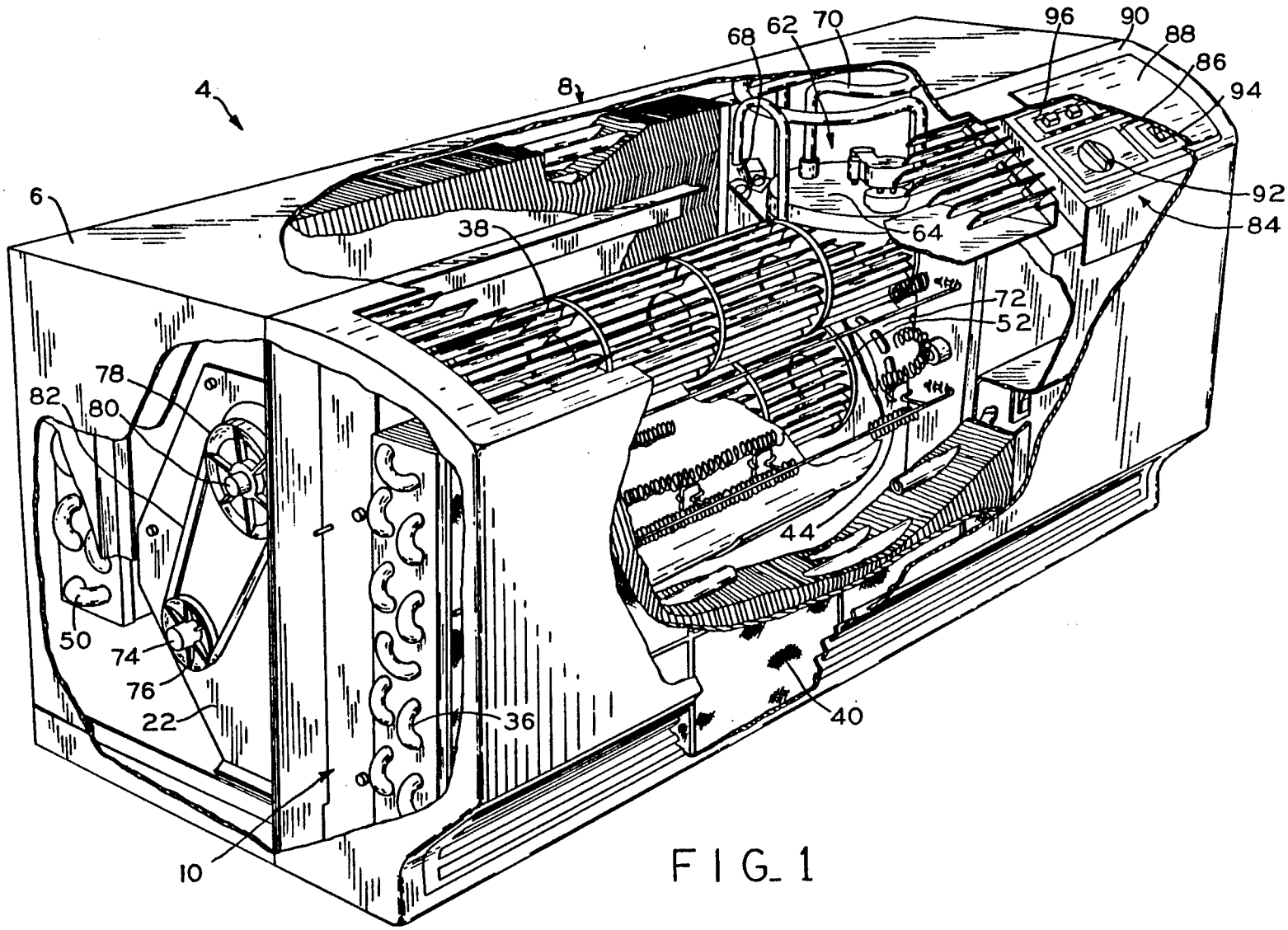
FIG. 1 is a perspective view in partial cross-section of an air conditioner according to the present invention.
Figure 2:
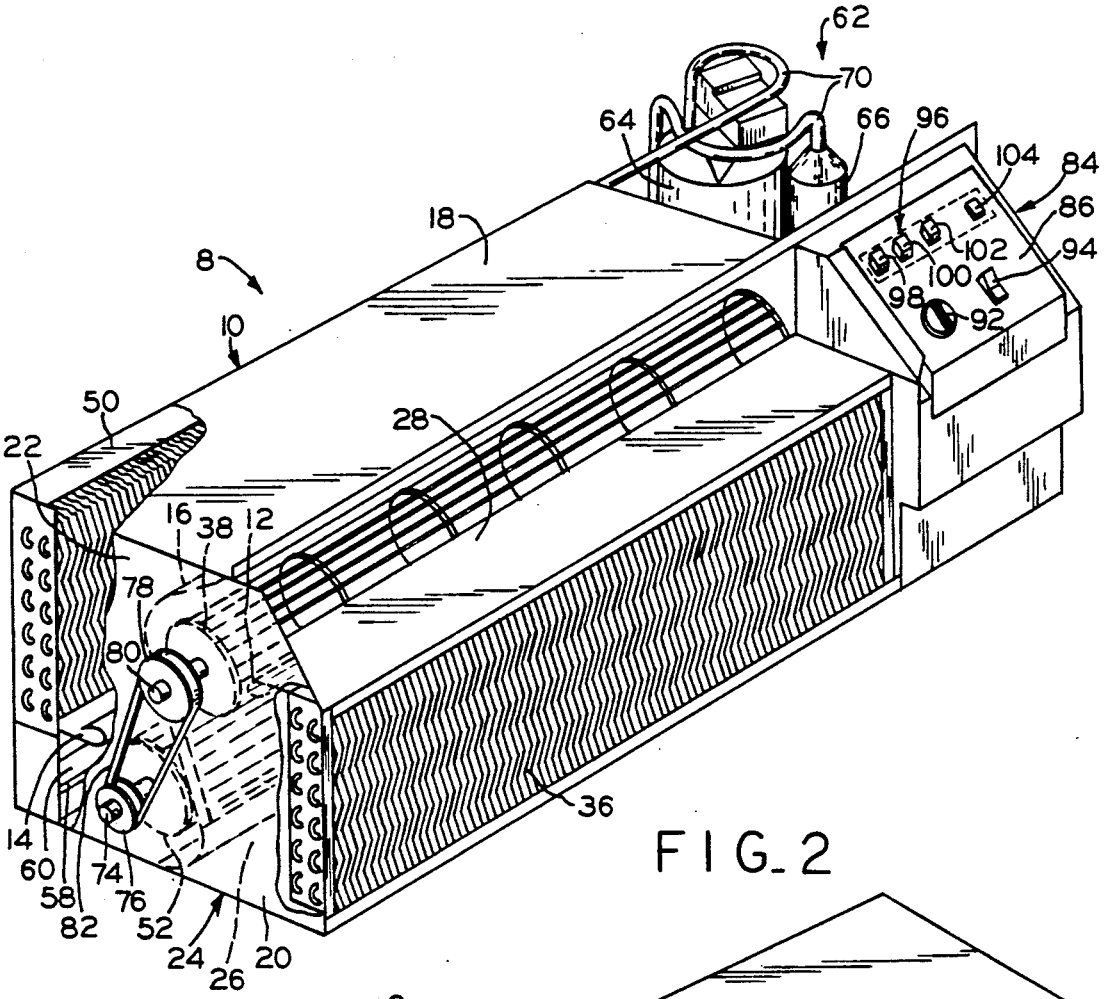
FIG. 2 is a perspective view of the front of the air conditioner with the cabinet removed.
Figure 3:
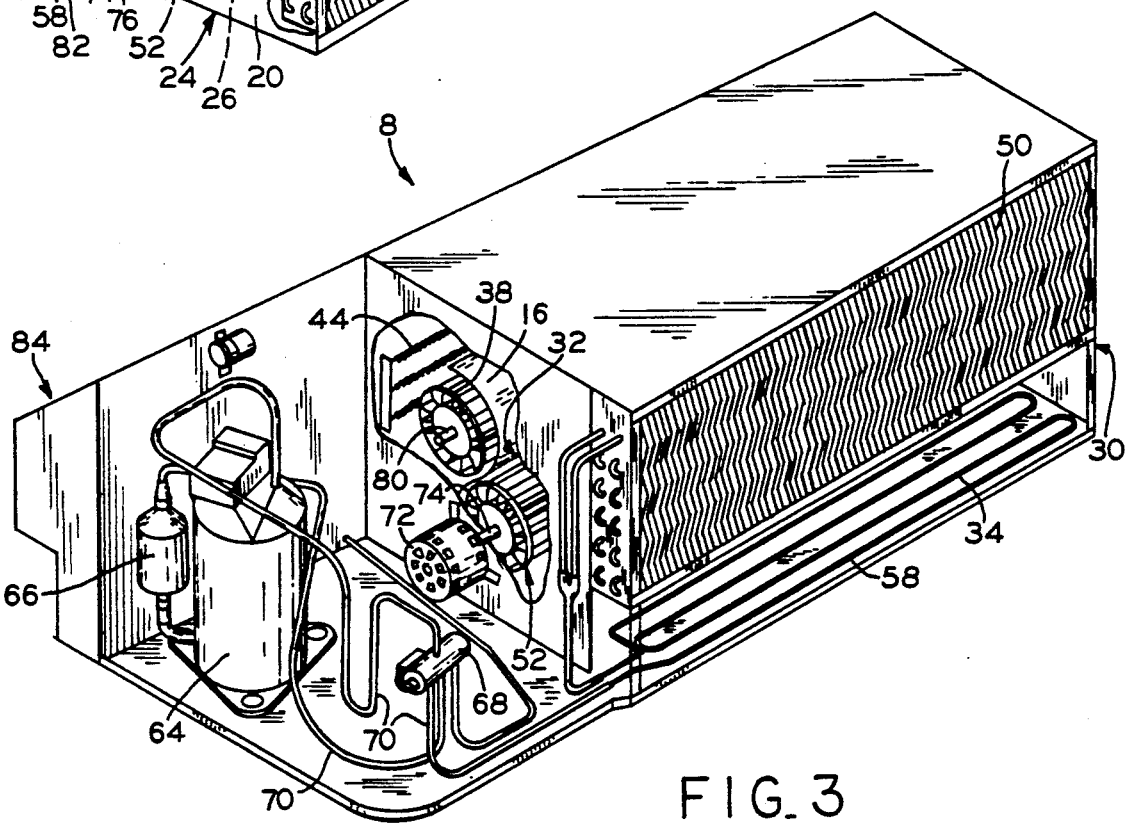
FIG. 3 is a perspective view of the rear of the air conditioner with the cabinet removed.

The present invention is a packaged terminal air conditioner 4 shown in FIGS. 1-3. Further details of a packaged terminal air conditioner are disclosed in copending U.S. patent applications entitled AIR CONDITIONER WITH DUAL CROSS FLOW BLOWERS, Ser. No. 478,342, and AIR INTAKE ARRANGEMENT FOR AIR CONDITIONER WITH DUAL CROSS FLOW BLOWERS, Ser. No. 478,416, filed on even date herewith and assigned to the assignee of the present invention, which disclosure is incorporated herein by reference. Within cabinet 6, the air conditioner unit 8 has four basic elements: housing 10, indoor cut-off 12, outdoor cut-off 14, and divider wall 16. Housing 10 has a top wall 18, a basepan 20, and side walls 22. Indoor cut-off 12 partitions the front or indoor compartment 24 into an indoor inlet section 26 and an indoor outlet section 28. Outdoor cut-off 14 partitions the rear or outdoor compartment 30 into an outdoor inlet section 32 and an outdoor outlet section 34. Divider wall 16 separates indoor compartment 24 and outdoor compartment 30.

Indoor compartment 24 has a heat exchange coil 36 located within inlet 26, and has a tangential or cross flow blower 38 located upwardly therefrom between indoor cut-off 12 and divider wall 16 near outlet 28. Filter 40 is placed in front of indoor heat exchanger 36 for filtering the recirculated air. Electric heating wires 44 extend within indoor compartment 24 between side walls 22 intermediate indoor heat exchanger 36 and blower 38; heating wires 44 provide additional heat when the heat pump alone cannot provide enough heat. Blower 38 induces a lower air flow which passes over heat exchanger 36 and heating wires 44 and is then exhausted upwardly through outlet 28.

Outdoor compartment 30 also has a heat exchange coil 50 located within inlet 32, and has tangential or cross flow blower 52 located downwardly between outdoor cut-off 14 and divider wall 16 near outlet 34. Blower 52 induces an upper air flow which passes over heat exchanger 50 and is then downwardly exhausted through outlet 34. Desuperheater coil 58 is located at the bottom 60 of outdoor compartment 30 and is used to evaporate condensate from indoor heat exchanger coil 36. Alternately, outdoor cut-off 14 can be positioned to capture condensate and route the condensate to a pump, draining valve, or other means of condensate disposal.

The refrigeration components 62 are positioned within cabinet 6 on one side of air conditioning housing 10. Compressor 64, accumulator 66, valve 68, and refrigerant lines 70 of components 62 operate in a known manner to appropriately heat or cool heat exchanger 36 for conditioning indoor air. Electric motor 72 is also located in the same general area of components 62, and drives both indoor blower 38 and outdoor blower 52.

In accordance with the present invention, motor 72 is connected to axis 74 of driving blower 52, preferably by a resilient hub (not shown). On the opposite side, pulleys 76 and 78 are connected to axes 74 and 80 of driving and driven blowers 52 and 38, respectively. Belt 82 couples pulleys 76 and 78 so that the rotational movement imparted to driving blower 52 is transmitted to driven blower 38. Preferably, driving pulley 76 has a smaller circumference than driven pulley 78 to provide a slower and more comfortable exhaust air flow for the indoor occupants.

The rotatable coupling (pulleys 76 and 78, belt 82) of blowers 38 and 52 is preferably located on the side of housing 10 opposite the refrigeration components 62. This arrangement allows for easy access to belt 82 and the pulleys 76 and 78 in the case of replacement or repair of those parts. Also, belt 82 is exposed to much less heat, moisture, and other by-products from the operation of motor 72 and components 62. The accessible, isolated position of the rotatable coupling of blowers 38 and 52 reduces the cost and increases the reliability of a package terminal air conditioner.

On opposite sides of divider wall 16, indoor blower 38 is positioned above outdoor blower 52. Axes 74 and 80 define a plane which is substantially vertically oriented. Because of the relative orientation of blowers 38 and 52, the depth of air conditioning unit 8 is minimized, and therefore the depth of the entire package terminal air conditioner 4 is correspondingly minimized.

Components 62 and motor 72 are electrically coupled to control unit 84. Control unit 84 is located on the same side of air conditioning housing 10 as components 62 and has a control panel 86 facing upwardly under control cover 88 of cabinet 6. Control cover 88, as well as the other parts of the top surface of indoor panel 90, has a sloping, curved upper surface which helps to prevent damage from the occupants placing heavy objects upon it. In one embodiment, control panel 86 has a rotary switch 92 for variably selecting the temperature intensity, a fan speed switch 94 for selecting between two different fan speeds, and four mutually exclusive mode setting switches 96: cooling mode 98, heating mode 100, fan only mode 102, and off 104. Also included within unit 84, although not shown, is a temperature limiting device which can be set by the owner to prevent the air conditioner from operating outside a predetermined range of temperature settings.

In operation, air conditioning unit 8 is activated by mode switches 96. If fan only switch 102 is switched on, then only motor 72 is activated to rotate blowers 38 and 52 according to a speed determined by fan speed switch 94. If cooling mode switch 98 is switched on, the compressor 64 begins to operate and valve 68 is positioned to cool indoor heat exchange 36, and motor 72 is activated to rotate blowers 38 and 52 according to a speed determined by fan speed switch 94. If the heating mode switch 100 is on, then compressor 64 begins to operate and valve 68 is positioned to heat indoor heat exchanger 36 and motor 72 is activated to rotate blowers 38 and 52 according to a speed determined by fan speed switch 94. Also in the heating mode, heating wires 44 may be actuated to produce additional heat and warm indoor air. In all of the modes except off 104, blowers 38 and 52 operate to induce air flow through inlets 26 and 32, the exhaust air through outlets 28 and 34.

The manufacture of packaged terminal air conditioner 4 is efficiently accomplished because of the bifurcated design. The air circulating portion is contained within housing 10, which can be assembled separately. Pulleys 76 and 78 are attached with belt 82 on the respective axes 74 and 80. Refrigeration components 62, associated motor 72, and control unit 84 can also be separately assembled on a frame (not shown). To complete an individual unit, housing 10 is attached to a frame, motor 72 is connected to axis 74, and refrigerant lines 70 are coupled to indoor heat exchanger 36, outdoor heat exchanger 50, and desuperheater coil 58.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. An air conditioner comprising:

a housing including first, second, third and fourth compartments, and divider walls for separating said compartments from each other;

first and second tangential blowers respectively mounted in said first and second compartments;

motor means for rotatingly driving said first blower, and mounted in said third compartment, said motor means directly connected to said first blower;

coupling means for rotatably coupling said first and second blowers located in said fourth compartment whereby said first blower rotatingly drives said second blower.

2. The air conditioner of claim 1 wherein said coupling means comprises a belt engaging two pulleys, each of said pulleys attached to a respective one of said first and second blowers.

3. The air conditioner of claim 1 and further comprising a compressor mounted in said third compartment.

4. The air conditioner of claim 1 wherein said first and second blowers each have a generally horizontal central axis, the central axes of said blowers being coplanar in a generally vertical plane.

5. The air conditioner of claim 1 wherein said coupling means drives said second blower at a rotational speed less than the rotational speed of said first blower.

6. A packaged terminal air conditioner comprising:

a housing including an indoor compartment, an outdoor compartment, a compressor compartment and a power train compartment, said compartments being separated from each other by divider walls, an indoor heat exchanger coil mounted in said indoor compartment and an outdoor heat exchanger coil mounted in said outdoor compartment;

a compressor connected to said indoor and outdoor heat exchanger coils, said compressor disposed in said compressor compartment;

an indoor tangential blower and outdoor tangential blower respectively mounted in said indoor and outdoor compartments, each said blower having an axis about which said respective blower rotates;

control means mounted exteriorly of said housing for selecting an operational mode for said air conditioner, said control means including a selection means for selecting the operational mode from a set of modes including heating, cooling, and fan only;

motor means for rotatingly driving one of said blowers and mounted in said compressor compartment, said motor means connected to said axis of said one blower;

a pair of pulleys attached to said respective blower axes; and a belt for rotatably coupling said pulleys, said coupling means located in said power train compartment, said coupling means adapted to transmit rotational motion from said one blower to the other of said blowers.

7. The air conditioner of claim 6 wherein said indoor and outdoor blowers are horizontally disposed and said axes are coplanar in a generally vertical plane.

8. The air conditioner of claim 6 wherein said coupling means drives said other blower at a rotational speed less than the rotational speed of said one blower.

* * * * *

UNITED STATES PATENT AND TRADEMARK OFFICE

CERTIFICATE OF CORRECTION

PATENT NO. : 5,094,089

DATED : March 10, 1992

INVENTOR(S) : Jimmy E. Lail

It is certified that error appears in the above-identified patent and that said Letters Patent is hereby corrected as shown below:

Claim 6, Column 6, Line 43-44 delete "coupling means" insert --belt--.

Claim 6, Column 6, Line 45 delete "coupling means" insert --belt--.

Signed and Sealed this

Twenty-second Day of June, 1993

*Attest:*

Michael K. Kirk

MICHAEL K. KIRK

*Attesting Officer*

*Acting Commissioner of Patents and Trademarks*